US011530812B2

(12) United States Patent
Brückner et al.

(10) Patent No.: US 11,530,812 B2
(45) Date of Patent: Dec. 20, 2022

(54) FEEDWATER CONTROL FOR A FORCED-FLOW WASTE-HEAT STEAM GENERATOR

(71) Applicant: Siemens Energy Global GmbH & Co. KG, Bayern (DE)

(72) Inventors: Jan Brückner, Uttenreuth (DE); Tobias Schulze, Erlangen (DE); Frank Thomas, Erlangen (DE)

(73) Assignee: Siemens Energy Global GmbH & Co. KG, Bayern (DE)

( * ) Notice: Subject to any disclaimer, the term of this patent is extended or adjusted under 35 U.S.C. 154(b) by 0 days.

(21) Appl. No.: 17/282,022

(22) PCT Filed: Sep. 19, 2019

(86) PCT No.: PCT/EP2019/075105

§ 371 (c)(1),
(2) Date: Apr. 1, 2021

(87) PCT Pub. No.: WO2020/088838

PCT Pub. Date: May 7, 2020

(65) Prior Publication Data

US 2021/0341139 A1 Nov. 4, 2021

(30) Foreign Application Priority Data

Oct. 29, 2018 (EP) ..... 18203107

(51) Int. Cl.
*F22D 5/26* (2006.01)
*F22B 35/12* (2006.01)
(Continued)

(52) U.S. Cl.
CPC ..... *F22B 35/12* (2013.01); *F22B 29/067* (2013.01); *F22D 5/30* (2013.01); *F22D 5/34* (2013.01)

(58) Field of Classification Search
CPC ..... F22D 5/30; F22D 5/34; F22D 5/26; F22D 1/00; F22D 1/003; F22B 35/12; F22B 35/102; F22B 35/007; F22B 29/067
See application file for complete search history.

(56) References Cited

U.S. PATENT DOCUMENTS 4,080,789 A * 3/1978 Frei ..... F22B 35/06 122/406.5
5,529,021 A * 6/1996 Butterlin ..... F22B 35/10 122/448.4

(Continued)

FOREIGN PATENT DOCUMENTS

CN 103249997 A 8/2013
DE 4217626 A1 12/1993

(Continued)

OTHER PUBLICATIONS

PCT International Search Report and Written Opinion of International Searching Authority dated Feb. 10, 2020 corresponding to PCT International Application No. PCT/EP2019/075105 filed Sep. 19, 2019.

*Primary Examiner* — Gregory A Wilson
(74) *Attorney, Agent, or Firm* — Wolter Van Dyke Davis, PLLC

(57) ABSTRACT

A method for operating a forced-flow steam generator constructed as a waste-heat steam generator having a pre-heater, including pre-heater heating surfaces, and having an evaporator including evaporator heating surfaces connected downstream on the flow medium side of the pre-heater heating surfaces. A device for adjusting a feed water mass flow has a set point for the feed water mass flow. During the creation of the set point for the feed water mass flow, a waste-heat flow transferred to a fluid in the evaporator heating surfaces is determined, and mass storage and energy storage in the fluid in the evaporator heating surfaces is (Continued)

detected during non-steady-state plant operation. A behaviour over time of a mass storage in the evaporator is coupled with a behaviour over time of a mass storage in the pre-heater, wherein scaling is carried out with a ratio of the density changes in the evaporator and pre-heater.

13 Claims, 2 Drawing Sheets

(51) Int. Cl.

| | |
|---|---|
| ***F22B 29/06*** | (2006.01) |
| ***F22D 5/30*** | (2006.01) |
| ***F22D 5/34*** | (2006.01) |

(56) References Cited

U.S. PATENT DOCUMENTS

| | | | | |
|---|---|---|---|---|
| 5,987,876 | A * | 11/1999 | Ziegner | F02C 6/003 60/776 |
| 7,007,473 | B2 * | 3/2006 | Nagatani | F01N 5/02 60/660 |
| 8,118,895 | B1 | 2/2012 | Wen et al. | |
| 9,482,150 | B2 * | 11/2016 | Neunteufl | F02G 5/02 |
| 9,482,427 | B2 * | 11/2016 | Brückner | F22B 37/38 |
| 9,593,844 | B2 * | 3/2017 | Brückner | F01K 13/02 |
| 10,167,743 | B2 * | 1/2019 | Olia | F22B 35/102 |
| 10,948,178 | B2 * | 3/2021 | Brückner | F22D 5/00 |
| 11,092,331 | B2 * | 8/2021 | Ruchti | F22B 35/108 |
| 11,092,332 | B2 * | 8/2021 | Koller | F22B 35/10 |
| 2010/0288210 | A1 | 11/2010 | Bruckner et al. | |
| 2011/0023487 | A1 * | 2/2011 | Olia | F22B 35/102 60/653 |
| 2013/0133751 | A1 * | 5/2013 | Backi | F01K 13/00 137/11 |
| 2013/0192229 | A1 | 8/2013 | Bruckner et al. | |
| 2014/0034044 | A1 | 2/2014 | Birnbaum et al. | |
| 2014/0109547 | A1 | 4/2014 | Bruckner et al. | |

FOREIGN PATENT DOCUMENTS

| | | | |
|---|---|---|---|
| DE | 102010040210 | A1 | 3/2012 |
| DE | 102011004263 | A1 | 8/2012 |
| EP | 2212618 | A2 | 8/2010 |
| EP | 2297518 | A2 | 3/2011 |
| JP | S5341602 | A | 4/1978 |
| JP | 2014519009 | A | 8/2014 |
| WO | 2012110342 | A2 | 8/2012 |

* cited by examiner $\frac{dM_{EV}}{dt}$
$\frac{dU_{EV}}{dt}$
$v_{EV}$
$\overline{M}_{EV}$
DT1
T1
T=120s
T=20s
*k
rho
h1s
h2s
p
T*
1, 2
3, 4
12, 13
5
6
7
8
9
10
11
14
15
16
17
18
19
20
21
22
23
24
25
26
27
28
29
30
31
32
33
34
35
36
37
38

FEEDWATER CONTROL FOR A FORCED-FLOW WASTE-HEAT STEAM GENERATOR

CROSS REFERENCE TO RELATED APPLICATIONS

This application is the US National Stage of International Application No. PCT/EP2019/075105 filed 19 Sep. 2019, and claims the benefit thereof. The International Application claims the benefit of European Application No. EP18203107 filed 29 Oct. 2018. All of the applications are incorporated by reference herein in their entirety.

FIELD OF INVENTION

The invention relates to a method for operating a once-through steam generator designed as a waste-heat steam generator. It also relates to a forced-flow steam generator for carrying out the method.

BACKGROUND OF INVENTION

The feedwater control concept for Benson evaporators is based substantially on the calculation of a pre-control signal for the feedwater mass flow on the basis of measured process variables. Such a pre-control signal is typically calculated from known setpoint values or disturbance variables of the control circuit or their changes and is finally corrected multiplicatively with the output signal of the controller. It anticipates the reaction of the controller to a change in the setpoint value or a disturbance variable and increases the dynamics of the controller, so that the desired overheating at the evaporator outlet (setpoint value) is set as well as possible in all conceivable phases of the process. In the application for the first time of a Benson evaporator in a waste-heat steam generator of a vertical type of construction, it has been found that, for design reasons, the controller intervention referred to must be much more pronounced than in the case of the known horizontal type of construction. However, this also increases the extent to which the control circuit can oscillate. This has the effect that an insufficient setting accuracy of the feedwater control valves (for example because of low hardware quality) is also becoming increasingly significant. Thus, in an extreme case, undesired residual process fluctuations of a significant order of magnitude can be observed in otherwise steady-state plant operation.

Feedwater control for Benson waste-heat steam generators is disclosed for example in EP 2 212 618 B1. There it is assumed that a sufficiently reliable predictive mass flow control that can also be used for steam generators connected as waste-heat boilers should be largely adapted to the particular features of the waste-heat boiler. Here it should be taken into account in particular that, unlike in the case of fired boilers, in this case the firing output is not a suitable parameter that allows a sufficiently reliable conclusion as to the underlying enthalpy balance. In particular, it should be taken into account here that, with a variable that is equivalent for waste-heat boilers, specifically the current gas turbine output, or parameters correlating with this, there are still further, internal gas-turbine parameters, so that no acceptable conclusion as to the enthalpy conditions when the heating gas enters the flue gas duct of the steam generator is possible. For the enthalpy balance used as the basis for the determination of the required feedwater flow, recourse should therefore be made to other, particularly suitable parameters, such as the heating gas temperature at the inlet into the evaporator and the mass flow of the heating gas.

EP 2 297 518 B1 also discloses that correction values characteristic of the temporal derivative of the enthalpy at the input of one or more of the evaporator heating surfaces are taken into account.

For the application in a solar-thermal power plant, DE 10 2010 040 210 A1 likewise discloses a method in which a correction value characteristic of the temporal derivative of the enthalpy, the temperature or the density of the flow medium at the input of one or more of the heating surfaces is taken into account for the creation of the setpoint value for the feedwater mass flow.

US 2014/034044 A1 claims in addition to a solar-thermal steam generator itself likewise a method for operating this solar-thermal steam generator, in which the setting of the feedwater mass flow is predictively controlled. Also used here for this purpose is a correction value, by which thermal effects of storage or withdrawal of thermal energy are corrected.

Finally, DE 10 2011 004 263 A1 also discloses a method for operating a solar-heated waste-heat steam generator in which a device for setting the feedwater mass flow is fed a setpoint value for the feedwater mass flow, wherein account is taken of a characteristic correction value by which thermal effects of storage or withdrawal of thermal energy in one or more of the heating surfaces are corrected.

Since the present problem occurred during the application for the first time of a Benson evaporator in a vertical waste-heat steam generator, there are no approaches to solving the problem that go any further. The solution to the problem chosen in this specific case was to reduce the gain of the controller again to some extent. However, if this approach is taken then, depending on the given boundary conditions, it is necessary to accept poorer operating behavior of the plant, and even in an extreme case undesired behavior.

SUMMARY OF INVENTION

An object of the invention is therefore to provide a method for operating a once-through steam generator designed as a waste-heat steam generator in which improved feedwater control leads to stable operating behavior of the plant. It is also intended to provide a forced-flow steam generator that is particularly suitable for carrying out the method.

The invention achieves the object directed at a method in that it provides that, in the case of a once-through steam generator designed as a waste-heat steam generator, with a pre-heater, comprising a number of pre-heater heating surfaces, and with an evaporator, comprising a number of evaporator heating surfaces connected downstream on the flow medium side of the pre-heater heating surfaces, in which a device for setting a feedwater mass flow is fed a setpoint value for the feedwater mass flow, wherein a waste heat flow transferred to a fluid in the evaporator heating surfaces is determined in the creation of the setpoint value for the feedwater mass flow and furthermore mass storage and energy storage in the fluid in the evaporator heating surfaces are detected during non-steady-state plant operation, a behavior over time of the mass storage in the evaporator is coupled to a behavior over time of a mass storage in the pre-heater, wherein scaling is carried out with a ratio of the changes in density in the evaporator and in the pre-heater.

It is important to understand that, with the present invention, it is not the case that an observer in the figurative sense is bound to a fluid particle and flows with it through the evaporator, but that the observer views the evaporator as a balancing space into which fluid flows in and out. During normal operation of the plant, a fluid particle will always take up energy on the way from the evaporator input to the evaporator output, no matter whether the operation of the plant is proceeding in a steady state or non-steady state. The situation is different when viewing the system according to the invention, where, during steady-state operation of the plant (the evaporator), the same temperatures and pressures are measured at a specific location in the evaporator at different times, and consequently the temporal derivatives of the corresponding terms in the formulae describing the process become zero. Thus, the changes over time of these parameters during non-steady-state operation of the evaporator are taken into account by the method according to the invention. It is of course possible here for there to be both instances of storage of energy or mass and instances of withdrawal of energy or mass.

With this method, in which the algorithm for calculating the pre-control signal, which in the prior art in the simplest case merely takes into account the heat flow $\dot{Q}_{Ev,fl}$ transferred to the fluid in the evaporator, obtained from the heat flow in the waste gas $\dot{Q}_{EG}$ minus the heat storage in the material of the wall of the heating surface tube $\dot{Q}_{S,W}$, is supplemented by the influence of the fluid-side mass and energy storage effects in the evaporator, the quality of the pre-control signal is further improved, in particular for the described application of the vertical waste-heat steam generator, and consequently the necessary correction by the controller is minimized. This potentially has the consequence that the controller can then be parameterized weaker again, so that the problem described above does not occur, but at the same time the operating behavior of the plant is also not adversely influenced.

Advantageously, the storage terms for mass storage and energy storage are determined from current measured values. This makes possible a particularly reliable evaluation of the energy flow balance, and consequently the determination of a particularly accurately precalculated feedwater setpoint value.

Expediently, the current measured values are pressures and temperatures at the pre-heater input, at the pre-heater output or at the evaporator input and at the evaporator output.

It is advantageous if a specific enthalpy of the fluid in the evaporator required for the estimation of the energy storage is approximated by the arithmetic mean value of the boiling enthalpy and saturation enthalpy.

It is in this case expedient if the boiling enthalpy and the saturation enthalpy are determined by way of at least one pressure measurement at the evaporator input or at the evaporator output.

The correction values for mass storage and energy storage for the determination of the setpoint value for the feedwater mass flow are advantageously determined while taking into account the temporal derivatives of the boiling and saturation enthalpies in the evaporator and also a density of the flow medium in the pre-heater. With regard to the density, an average flow density in the pre-heater can be defined and calculated in particular by suitable measurements of the temperature and the pressure at the inlet and at the outlet of the respective pre-heater heating surface, wherein a linear density profile is expediently taken as a basis. This makes it possible to compensate for mass storage effects occurring when there are transient processes.

If, for example, the heat supply into the evaporator heating surfaces drops when there is a change in load, fluid is temporarily stored there. With a constant delivery flow of the feedwater pump, the mass flow at the outlet of the heating surface would consequently drop. It is possible to compensate for this by a temporary increase of the feedwater mass flow.

In practice, these time-variable processes or temporal derivatives are advantageously determined by way of first and second differential elements, preferably DT1 elements, to which parameters such as temperature and pressure are fed on the input side at suitable measuring points.

It is advantageous in this respect if the first differential element, describing the variation over time of the change in density in the pre-heater for the estimation of the mass storage, is subjected to a gain factor corresponding to the total volume of the flow medium in the evaporator heating surfaces.

The correction signals generated by the invention for the feedwater mass flow can replicate effects of the mass and energy storage particularly advantageously if suitable gains and time constants are chosen for the respective DT1 element.

In particular, it is advantageous if the first differential element is subjected to a time constant corresponding to substantially half the transit time of the flow medium through the evaporator.

It is also advantageous if the second differential element for the estimation of the energy storage is subjected to a time constant that lies between 5 s and 40 s.

With respect to the forced-flow steam generator, the stated object is achieved by a forced-flow steam generator with a number of evaporator heating surfaces and a number of pre-heater heating surfaces connected upstream on the flow medium side and with a device for setting the feedwater mass flow, which can be guided on the basis of a setpoint value for the feedwater mass flow, wherein the setpoint value is designed on the basis of the method according to the invention.

With the present invention, the correction of the pre-control signal by the controller can be notably reduced and the controller can be parameterized with a smaller gain. The problem described above of undesired residual process fluctuations of a significant order of magnitude can in this way be eliminated. The operating behavior of the plant is not adversely influenced.

Empirically found correction factors are also conceivable for the pre-control signal (or even entire parameter fields). However, finding them requires a very great effort. By contrast with this, the invention described is based on physical approaches and does not have to be parameterized further.

BRIEF DESCRIPTION OF THE DRAWINGS

The invention is explained more specifically by way of example on the basis of the schematic drawings, in which.

DETAILED DESCRIPTION OF INVENTION

Figure 1:
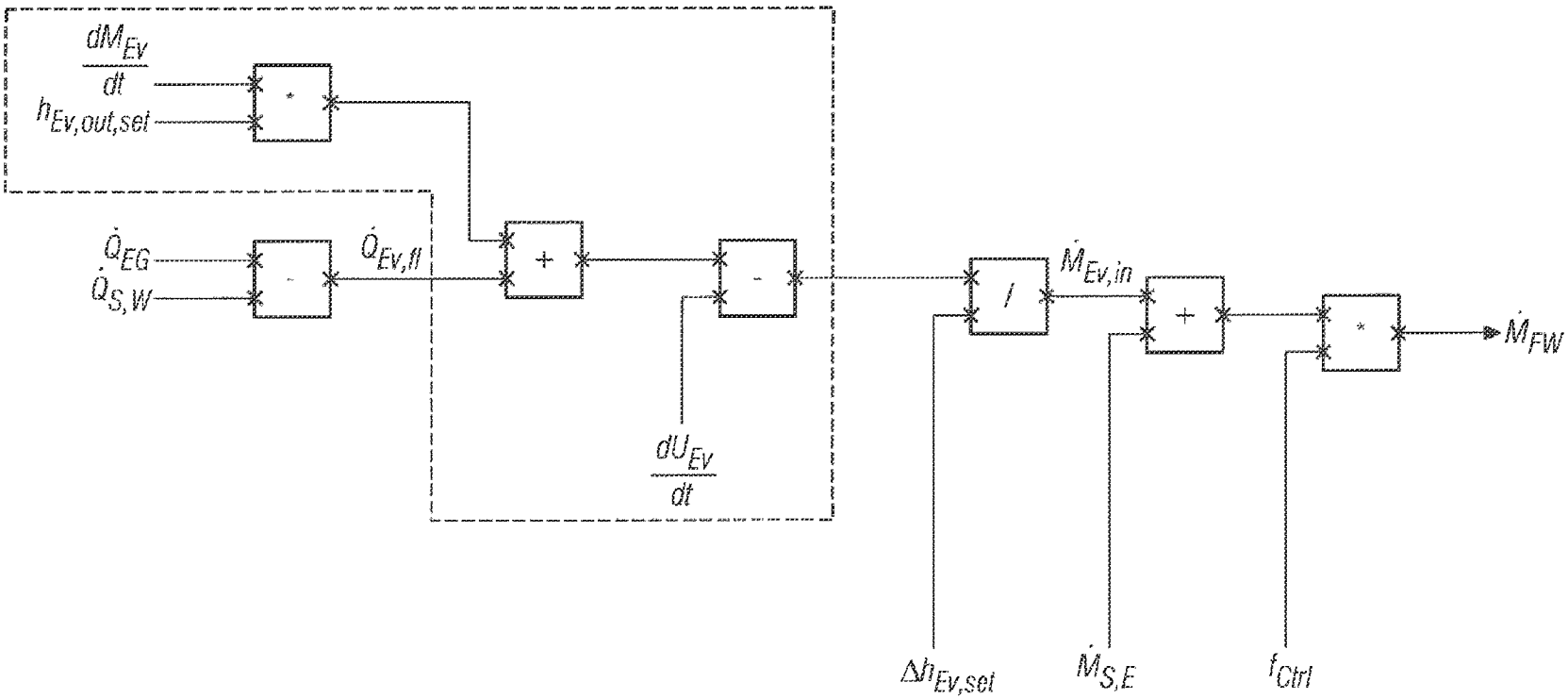
FIG. 1 shows a diagram of the algorithm for calculating the feedwater mass flow and FIG. 2 shows a representation of the measured variables and the approximations derived therefrom for the changes in the algorithm for calculating the setpoint value of the feedwater mass flow, as they are to be implemented in automation of the power plant.

FIG. 1 schematically shows the change in the algorithm resulting from the invention for calculating the setpoint value for the feedwater mass flow $\dot{M}_{FW}$. In this case, the component of the algorithm that is relevant to the invention is shown inside the surrounding border indicated by dashed lines and the prior art is shown outside.

The setpoint value for the feedwater mass flow $\dot{M}_{FW}$ is accordingly made up of the feedwater mass flow for the evaporator $\dot{M}_{Ev,in}$ and the mass flow $\dot{M}_{S,E}$ stored in the pre-heater or withdrawn from it, corrected by a factor $f_{Ctrl}$.

The feedwater mass flow for the evaporator $\dot{M}_{Ev,in}$ is obtained according to the prior art as the quotient of the heat flow $\dot{Q}_{Ev,fl}$ transferred from the waste gas to the fluid in the evaporator and the setpoint value for the change in enthalpy in the evaporator $\Delta h_{Ev,set}$. The heat flow $\dot{Q}_{Ev,fl}$ transferred to the fluid in the evaporator is obtained once again from the heat flow in the waste gas $\dot{Q}_{EG}$ minus the heat storage in the material of the wall of the heating surface tube $\dot{Q}_{S,W}$.

According to the invention, the term for the heat flow transferred to the fluid in the evaporator is supplemented and corrected by two further terms.

The first correction concerns the mass storage effect in the evaporator, the second correction concerns the energy storage effect in the evaporator.

The mass storage effect is represented in the heat flows of FIG. 1 by the product of $$\frac{dM_{Ev}}{dt}$$

(mass storage) and $h_{Ev,out,set}$ (enthalpy at the outlet of the evaporator)

$$\frac{dU_{Ev}}{dt}$$

stands for the energy storage effect.

These values are suitably approximated according to the invention, so that they can be determined from measured process variables.

Figure 2:
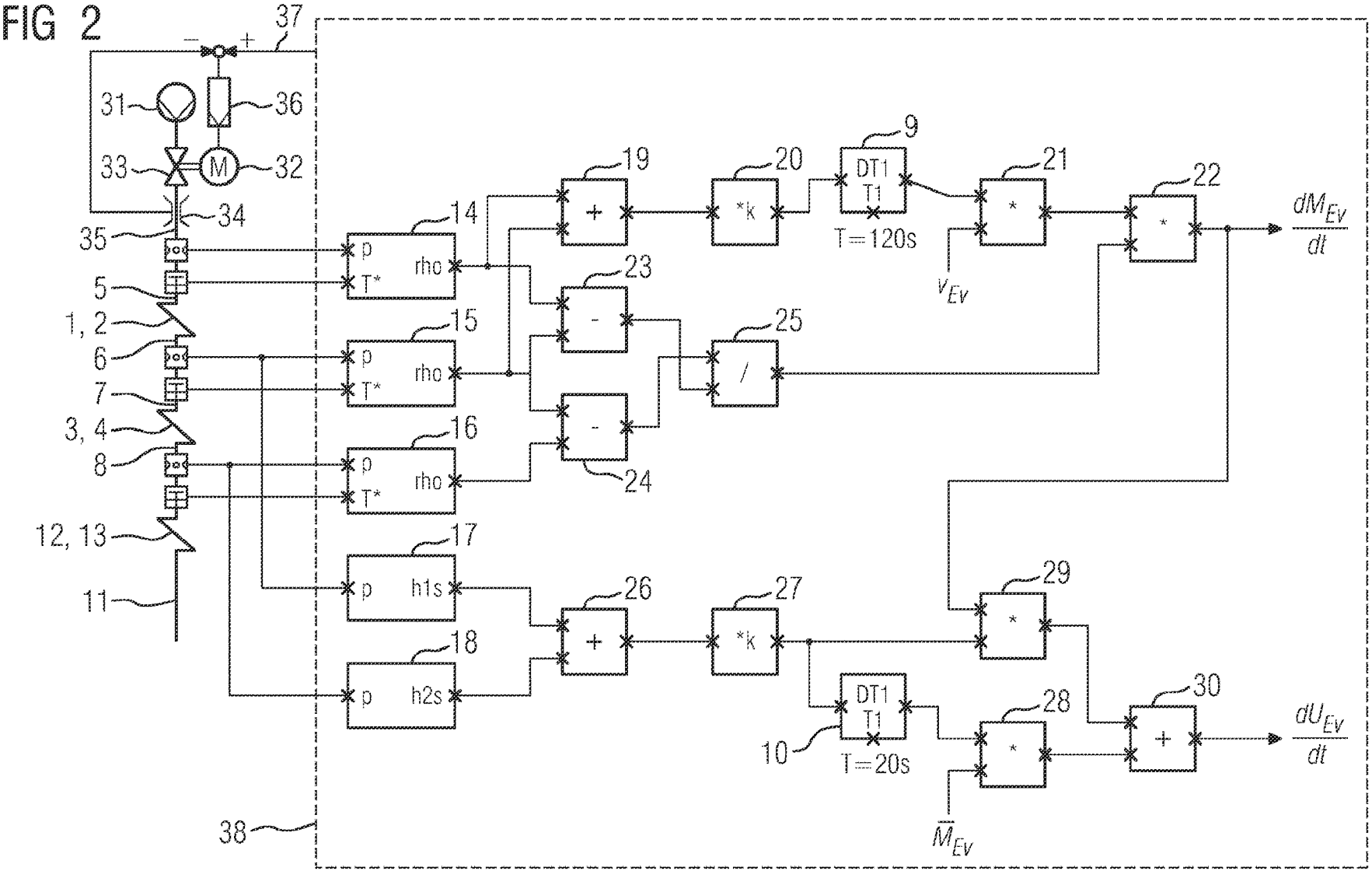

FIG. 2 shows these measured variables and the measuring points in the forced-flow waste-heat steam generator and their processing.

The forced-flow waste-heat steam generator according to FIG. 2 comprises a pre-heater 1, also referred to as an economizer, for feedwater provided as a flow medium, with a number of pre-heater heating surfaces 2, and an evaporator 3, with a number of evaporator heating surfaces 4 connected downstream on the flow medium side of the pre-heater heating surfaces 2. The evaporator 3 is followed by a superheater 12 with corresponding superheater heating surfaces 13. The heating surfaces are located in a gas exhaust, which is not shown any more specifically and to which the waste gas of an assigned gas turbine plant is admitted.

As already stated, the forced-flow steam generator is designed for controlled admission of feedwater. For this purpose, a throttle valve 33 activated by a servomotor 32 is arranged downstream of a feedwater pump 31, so that, by way of suitable activation of the throttle valve 33, the amount of feedwater delivered by the feedwater pump 31 in the direction of the pre-heater 1 or the feedwater mass flow can be set. For determining a current characteristic value for the fed feedwater mass flow, arranged downstream of the throttle valve 33 is a measuring device 34 for determining the feedwater mass flow through the feedwater line 35. The servomotor 32 is activated by way of a control element 36, which is subjected on the input side to a setpoint value for the feedwater mass flow $\dot{M}_{FW}$, fed via a data line 37, and the current actual value of the feedwater mass flow, determined by way of the measuring device 34. By forming the difference between these two signals, an adjustment requirement is transmitted to the controller 36, so that, if there is a deviation of the actual value from the setpoint value, a corresponding adjustment of the throttle valve 33 is performed by way of the activation of the motor 32.

For determining a setpoint value for the feedwater mass flow $\dot{M}_{FW}$ that is particularly appropriate for the requirement, in the manner of a setting of the feedwater mass flow that is predictive, forward-looking or based on the future or current requirement, the data line 37 is connected on the input side to a feedwater flow control 38 designed for selecting the setpoint value for the feedwater mass flow $\dot{M}_{FW}$. This is designed to determine the setpoint value for the feedwater mass flow $\dot{M}_{FW}$ on the basis of an enthalpy balance in the evaporator heating surfaces 4, wherein the setpoint value for the feedwater mass flow $\dot{M}_{FW}$ is determined by providing that a waste heat flow transferred to a fluid in the evaporator heating surfaces 4 is determined and furthermore mass storage and energy storage in the fluid in the evaporator heating surfaces 4 are taken into account. At the expense of completeness, but to the benefit of overall clarity, FIG. 2 only shows in the feedwater flow control 38 the elements that are relevant to the correction according to the invention of the feedwater mass flow setpoint value $\dot{M}_{FW}$. The part known from the prior art is not shown.

The measured values for determining a setpoint value for the feedwater mass flow $\dot{M}_{FW}$ are pressure and temperature values and the measuring points lie in the regions of the pre-heater input 5, pre-heater output 6 or evaporator input 7 and evaporator output 8.

The measured values determined are processed in functional elements 14, 15, 16, 17 and 18. By means of the first, second and third functional elements 14, 15 and 16, the density of the fluid at various locations of the heating surfaces of the pre-heater 1 and evaporator 3 are determined from the measured values for pressure and temperature. The fourth and fifth functional elements 17 and 18 provide the boiling enthalpy and saturation enthalpy from measured pressure values.

The storage term for the mass storage $$\frac{dM_{Ev}}{dt}$$

is approximated, in that first a mean value is formed from the determined densities at the pre-heater input 5 and at the pre-heater output 6, by way of a first adding element 19 and a first multiplying element 20, the mean value is subsequently processed further with a correspondingly chosen time constant in the first differential element 9 and subjected to a gain factor corresponding to the total volume $V_{Ev}$ of the flow medium in the evaporator heating surfaces 4 in the second multiplying element 21.

Further scaling takes place in a following third multiplying element 22 with a ratio of the changes in density of the fluid in the evaporator 3 and in the pre-heater 1, which is determined by means of the first and second subtracting elements 23 and 24 and the first dividing elements 25 in the way shown in FIG. 2.

The storage term for the energy storage $$\frac{dU_{Ev}}{dt}$$

is approximated, in that a mean value is formed from the determined enthalpies with the aid of the second adding element 26 and the fourth multiplying element 27. This mean value represents a good assumption for the specific enthalpy of the fluid in the evaporator 3.

The storage term for the energy storage is $$\frac{dU_{Ev}}{dt}$$

then determined by the sum of two terms. The first term is determined by the specific enthalpy of the fluid in the evaporator 3 being processed further with a correspondingly chosen time constant in the second differentiating element 10 and subjected to a mean value of the fluid masses $\overline{M}_{Ev}$ in the evaporator under maximum and minimum load in the fifth multiplying element 28. For the sake of simplicity, this mean value is regarded as a time-constant value. The second term is determined in that the specific enthalpy of the fluid in the evaporator 3 is multiplied by the storage term for the mass storage $$\frac{dM_{Ev}}{dt}.$$

This takes place in the sixth multiplying element 29.

In the third adding element 30, the two terms are brought together.

The corresponding algorithm is to be implemented in the functional plans of the feedwater control, and consequently in the automation of the power plant.

The invention claimed is:

1. A method for operating a once-through steam generator designed as a waste-heat steam generator, with a pre-heater, comprising a number of pre-heater heating surfaces, and with an evaporator, comprising a number of evaporator heating surfaces connected downstream on the flow medium side of the pre-heater heating surfaces, the method comprising:

determining a setpoint value for a feedwater mass flow based on a waste heat flow transferred to a fluid in the evaporator heating surfaces, and detecting mass storage and energy storage in the fluid in the evaporator heating surfaces during non-steady-state plant operation, wherein a behavior over time of the mass storage in the evaporator is coupled to a behavior over time of a mass storage in the pre-heater, and wherein scaling is carried out with a ratio of the changes in density in the evaporator and in the pre-heater.

2. The method as claimed in claim 1, wherein storage terms for mass storage and energy storage are determined from current measured values.

3. The method as claimed in claim 2, wherein the current measured values are pressures and temperatures at the pre-heater input, at the pre-heater output or at the evaporator input and at the evaporator output.

4. The method as claimed in claim 1, wherein a specific enthalpy of the fluid in the evaporator required for the estimation of the energy storage is approximated by the arithmetic mean value of the boiling enthalpy and saturation enthalpy.

5. The method as claimed in claim 4, wherein the boiling enthalpy and the saturation enthalpy are determined by way of at least one pressure measurement either at the evaporator input or at the evaporator output.

6. The method as claimed in claim 5, wherein temporal derivatives of the boiling and saturation enthalpies in the evaporator and also a density of the flow medium in the pre-heater are evaluated.

7. The method as claimed in claim 6, wherein the temporal derivatives are determined by way of first and second differential elements.

8. The method as claimed in claim 7, wherein the first differential element, describing the variation over time of the change in density in the pre-heater for the estimation of the mass storage, is subjected to a gain factor corresponding to the total volume of the flow medium in the evaporator heating surfaces.

9. The method as claimed in claim 7, wherein the first differential element is subjected to a time constant corresponding to substantially half the transit time of the flow medium through the evaporator.

10. The method as claimed in claim 7, wherein the second differential element for the estimation of the energy storage is subjected to a time constant that lies between 5 s and 40 s.

11. A forced-flow waste-heat steam generator, comprising:

a number of evaporator heating surfaces, a number of pre-heater heating surfaces connected upstream on the flow medium side, and a device for setting the feedwater mass flow, which can be guided on the basis of a setpoint value for the feedwater mass flow, wherein the setpoint value is designed on the basis of the method as claimed in claim 1.

12. The method as claimed in claim 1, wherein during steady-state plant operation, the temperatures and pressures measured at a specific location in the evaporator at different times are the same, such that the temporal derivatives describing the process become zero.

13. The method as claimed in claim 1, wherein during non-steady-state plant operation, changes in the temperatures and pressures measured at a specific location in the evaporator at different times are taken into account.

* * * * *